US006435840B1

(12) United States Patent
Sharma et al.

(10) Patent No.: US 6,435,840 B1
(45) Date of Patent: Aug. 20, 2002

(54) ELECTROSTRICTIVE MICRO-PUMP

(75) Inventors: Ravi Sharma, Fairport; Jeffrey I. Hirsh, Rochester; Gilbert A. Hawkins, Mendon, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/747,215

(22) Filed: Dec. 21, 2000

(51) Int. Cl.[7] ..... F04B 17/00
(52) U.S. Cl. ..... 417/322; 417/474
(58) Field of Search ..... 417/322, 474, 417/475

(56) References Cited

U.S. PATENT DOCUMENTS

| | | | | |
|---|---|---|---|---|
| 2,896,507 A | | 7/1959 | Mast et al. | 88/61 |
| 3,270,672 A | | 9/1966 | Haines et al. | 103/1 |
| 3,716,359 A | | 2/1973 | Sheridon | 96/1.1 |
| 4,065,308 A | | 12/1977 | Bergen | 96/1.5 R |
| 4,115,036 A | | 9/1978 | Patterson | 417/322 |
| 4,163,667 A | | 8/1979 | Wysocki | 96/1.5 N |
| 4,395,719 A | | 7/1983 | Majewski et al. | 346/140 R |
| 4,449,893 A | | 5/1984 | Beckman et al. | 417/322 |
| 4,794,370 A | * | 12/1988 | Simpson et al. | 340/825 |
| 4,822,250 A | * | 4/1989 | Tsubouchi et al. | 417/45 |
| 5,129,789 A | * | 7/1992 | Thornton et al. | 417/53 |
| 5,192,197 A | | 3/1993 | Culp | 417/322 |
| 5,327,041 A | | 7/1994 | Culp | 310/328 |
| 5,495,280 A | | 2/1996 | Gehner et al. | 347/8 |
| 5,585,069 A | | 12/1996 | Zanzucchi et al. | 422/100 |
| 5,593,838 A | | 1/1997 | Zanzucchi et al. | 435/6 |
| 5,603,351 A | | 2/1997 | Cherukuri et al. | 137/597 |
| 5,705,018 A | * | 1/1998 | Hartley | 156/345 |
| 5,836,750 A | * | 11/1998 | Cabuz | 417/322 |
| 5,917,693 A | * | 6/1999 | Kono et al. | 361/525 |
| 5,961,298 A | | 10/1999 | Bar-Cohen et al. | 417/322 |
| 5,963,235 A | | 10/1999 | Chwalek et al. | 347/82 |
| 6,007,309 A | * | 12/1999 | Hartley | 417/322 |
| 6,042,209 A | | 3/2000 | Hawkins et al. | 347/6 |
| 6,055,003 A | | 4/2000 | Hawkins et al. | 346/140.1 |
| 6,074,179 A | * | 6/2000 | Kokela et al. | 417/322 |

FOREIGN PATENT DOCUMENTS

JP 09287571 A * 11/1997

* cited by examiner

*Primary Examiner*—Charles G. Freay
*Assistant Examiner*—Han L Lin
(74) *Attorney, Agent, or Firm*—Thomas W. Cole; Milton S. Sales

(57) ABSTRACT

An electrostrictive micro-pump is provided for controlling a fluid flow through a cannula or other narrow liquid conduit. The micro-pump includes a pump body having a passageway for conducting a flow of fluid, a pump element formed from a piece of viscoelastic material and disposed in the passageway, and a control assembly coupled to the viscoelastic material for electrostatically inducing a peristaltic wave along the longitudinal axis of the pump element to displace fluid disposed within the pump body. The control assembly includes a pair of electrodes disposed over upper and lower sides of the pump element. The lower electrode is formed from a plurality of uniformly spaced conductive panels, while the upper electrode is a single sheet of conductive material. A switching circuit is provided for actuating the conductive panels of the lower electrode in serial, multiplex fashion to induce a peristaltic pumping action.

23 Claims, 5 Drawing Sheets

ELECTROSTRICTIVE MICRO-PUMP

CROSS REFERENCE TO RELATED APPLICATIONS

This application includes subject matter that is related to co-pending U.S. patent application Ser. No. 09/735,012 entitled ELECTROSTRICTIVE VALVE FOR MODULATING A FLUID FLOW, filed in the names of Ravi Sharma et al. on filed Dec. 12, 2000.

FIELD OF THE INVENTION

The present invention relates generally to micro-pumps, and more particularly to a micro-pump that utilizes electrostatic forces to create a peristaltic deformation in a viscoelastic material disposed in the passageway of a pump body to precisely pump small quantities of liquids.

BACKGROUND OF THE INVENTION

Various types of micro-pumps are known for pumping a controlled flow of a small quantity of liquid. Such micro-pumps find particular use in fields such as analytical chemistry wherein an accurate and measured control of a very small liquid flow is required. Such micro-pumps are also useful in the medical field for regulating precise flows of small amounts of liquid medications.

Many prior art micro-pumps utilize electromechanical mechanisms which while effective are relatively complex and expensive to manufacture on the small scales necessary to control small fluid flows. For example, micro-pumps utilizing piezoelectric materials are known wherein a pump element is oscillated by the application of electrical impulses on piezoelectric crystals to create a pressure differential in a liquid. Unfortunately, piezoelectric crystals are formed from brittle, ceramic materials which are difficult and expensive to machine, particularly on small scales. Additionally, piezoelectric materials generally are not suitable for interfacing with liquids. Thus, micro-pumps that exploit piezoelectric movement must be designed to insulate the piezoelectric crystals from contact with liquid materials. Finally, piezoelectric materials generally cannot be fabricated by way of known CMOS processes. Hence, while the electrical circuitry necessary to drive and control piezoelectric movement with a micro-pump may be easily and cheaply manufactured by CMOS processes, the integration of the piezoelectric materials into such circuits requires relatively specialized and slow fabrication steps.

Clearly, there is a need for a micro-pump which is capable of inducing a precise flow of a small amount of a liquid without the need for relatively expensive and difficult to machine materials. Ideally, all of the components of such a micro-pump could be manufactured from relatively inexpensive, easily-worked with materials which are compatible both with contact with liquid and with CMOS manufacturing techniques.

SUMMARY OF THE INVENTION

A main aspect of the invention is the provision of an electrostrictive micro-pump for pumping a controlled amount of fluid that overcomes or at least ameliorates all of the aforementioned shortcomings associated with the prior art. The micro-pump of the invention comprises a pump body having a passageway for conducting a flow of fluid, a pump element formed from apiece of viscoelastic material and disposed in the passageway, and a control assembly coupled with the viscoelastic material for inducing an elastic deformation in the shape of the material that creates a pressure differential in fluid disposed in the pump body passageway.

The control assembly may include a pair of electrodes disposed on opposite sides of the viscoelastic material, a source of electrical voltage connected to the electrodes, and a switching circuit for selectively applying a voltage from the source across the electrodes to generate an electrostatic force therebetween that deforms the viscoelastic material. One of the electrodes may be a flexible electrically conducting coating disposed over an upper, fluid contacting side of the viscoelastic material, while the other electrode is preferably a plurality of conductive panels uniformly spaced over a lower, opposing side of the viscoelastic material that is mounted in the passageway of the pump body. The switching circuit preferably includes a multiplexer for sequentially applying voltage from the voltage source to the conductive panels of the lower electrode to induce a peristaltic deformation in the viscoelastic material along the pump body passageway.

The viscoelastic material forming the pump element may be a silicon elastomer. Additionally, the electrodes of the control assembly are preferably formed from a coating of a conductive metal, such as gold, silver, or nickel, or a conductive polymer such as poly pyrrole, polyanaline, or poly thiophene. Alternatively, the conductive coating forming either of the electrodes may be formed from diamond-like carbon. In all cases, the coatings are thin enough so as not to interfere with the desired, peristaltic deformation of the viscoelastic material upon the application of a voltage.

The electrostrictive micro-pump of the invention is fabricated from relatively inexpensive and easily worked with materials, and the electrode structure of the control assembly may be easily manufactured by CMOS technology. The inherent elastic properties of commercially available viscoelastic materials advantageously allow for peristaltic movements of the valve element at accurately controllable frequencies up to 12.5 kHz.

BRIEF DESCRIPTION OF THE DRAWINGS

FIGS. 3A–3E illustrate how the voltage source and multiplexer of the switching circuit cooperate to generate a peristaltic deformation along the longitudinal axis of the pump element in order to pump fluid disposed in the pump body.

DETAILED DESCRIPTION OF THE INVENTION

Figure 1A:
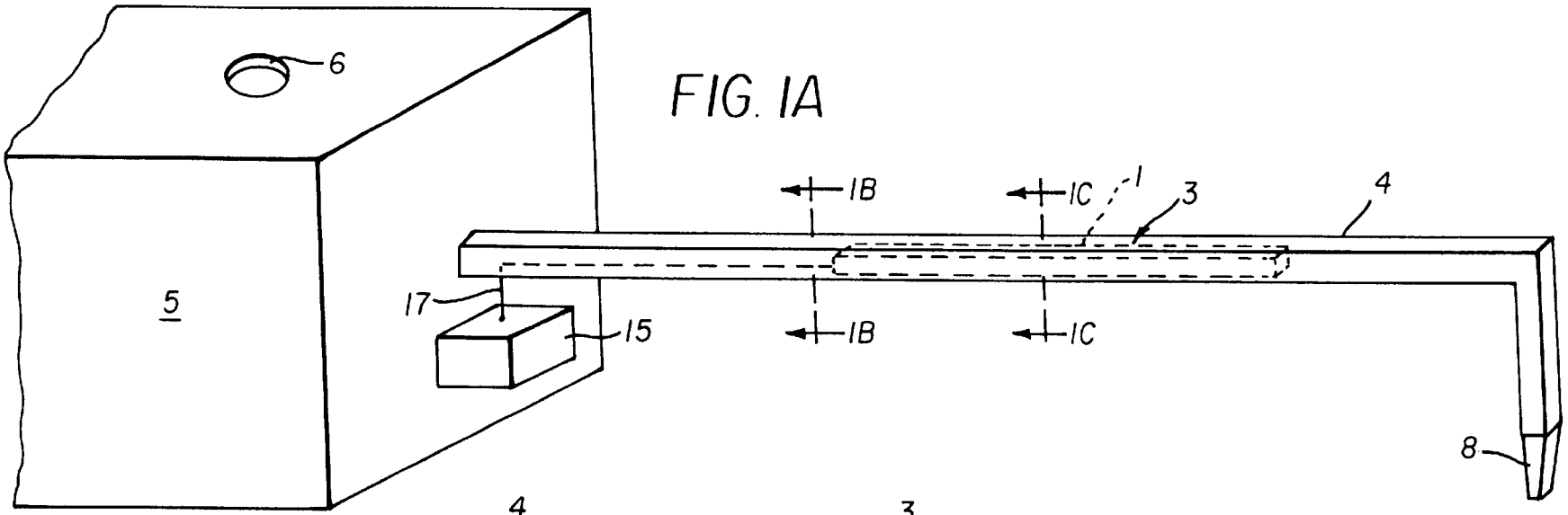
FIG. 1A is a perspective view of a cannula in which the electrostrictive micro-pump of the invention is mounted in order to control a micro flow of liquid therethrough.
Figure 1B:
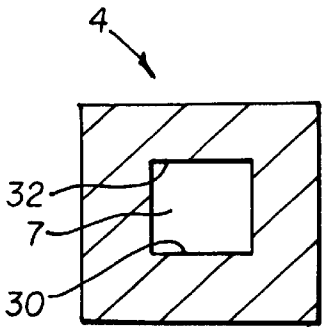
FIG. 1B is a cross-sectional end view of the cannula illustrated in FIG. 1A across the line 1B—1B.
Figure 1C:
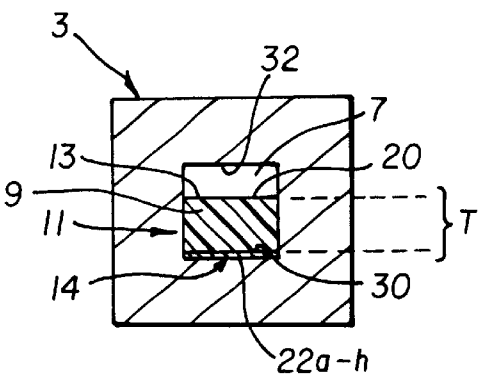
FIG. 1C is a cross-sectional end view of the cannula illustrated in FIG. 1A across the line 1C—1C illustrating an end cross-sectional view of the micro-pump installed therein.

With reference now to FIGS. 1A, 1B, and 1C, the electrostrictive micro-pump 1 of the invention includes a pump body 3, which, in this example, is a section of a cannula connected to a source of liquid 5. The liquid source 5 includes a vent hole 6 for preventing the formation of a vacuum which could, interfere with the operation of the micro-pump 1.

In this example, the cannula 4 has a passageway 7 with a substantially square cross-section as best seen in FIG. 1B. The passageway 7 of the cannula 4 extends from the vented liquid source 5 to a liquid outlet 8. Outlet 8 may be, for example, a nozzle for injecting micro quantities of solvents or solutions in an analytical chemical apparatus. Alternatively, the vented source of liquid 5 may be a container of a liquid medication, and the cannula 4 may be used to administer precise quantities of medication to a patient.

Figure 2:
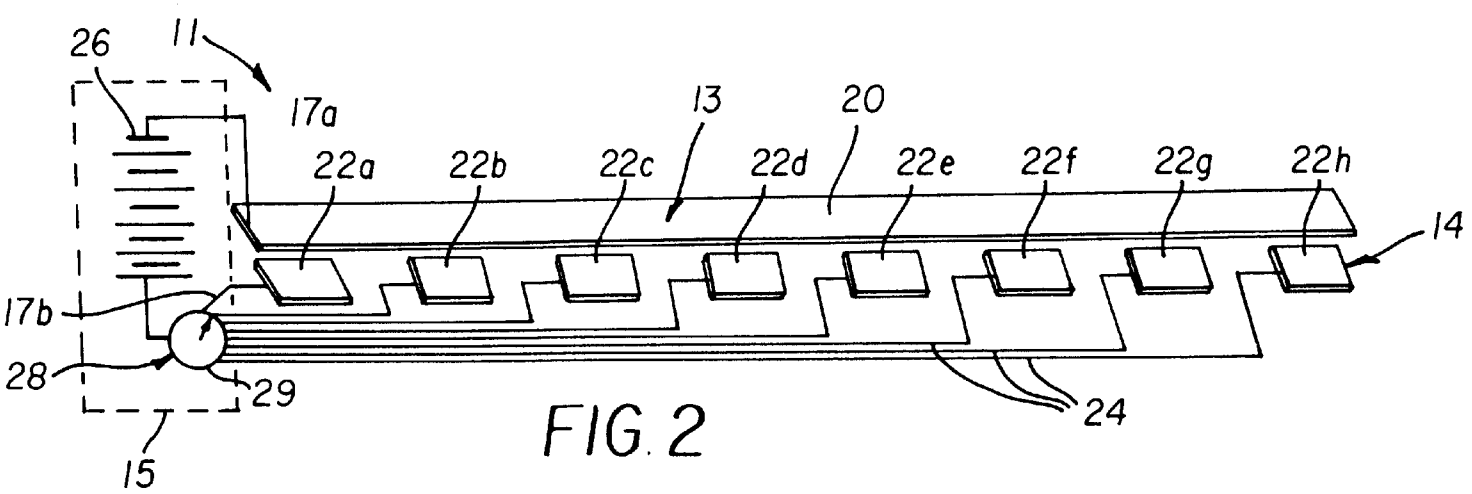
FIG. 2 is a perspective view of the control assembly of the invention as it would appear removed from the cannula of FIG. 1A, and without the viscoelastic pump element disposed between the electrodes.

With reference now to FIGS. 1C and 2A, the pump element 9 of the electrostrictive micro-pump 1 is a rectangularly-shaped piece of viscoelastic material such as the silicon elastomer sold as "Sylguard 170" obtainable from the Dow Chemical Corporation located in Midland, Mich. However, the invention is not confined to this one particular material, and encompasses any elastomer having viscoelastic properties. In the preferred embodiment, the thickness T of the viscoelastic material forming the pump element 9 may be 5 to 10 microns thick.

With reference again to FIG. 2A, the control assembly 11 includes upper and lower electrodes 13 and 14 which cover upper and lower surfaces of the valve element 9 in sandwich-like fashion. Electrodes 13 and 14 are in turn connected to a source 15 of electrical voltage via conductors 17 which may be metallic strips fabricated on the surface of the cannula 4 via CMOS technology. The upper electrode 13 may be formed from a thin layer of a flexible, conductive material applied to the upper surface of the pump element 9 by vapordeposition or other type of CMOS-compatible coating technology. Examples of conductive materials which may be used for the layer 20 includes electrically conductive polymers such as polypyrrole, polyanaline, and polythiophene. Alternatively, a relatively non-reactive metal such as gold, silver, or nickel may be used to form the layer 20. Of course, other conductive metals such as aluminum could also be used but less reactive metal coatings are generally more preferred, since they would be able to interface with a broader range of liquids without degradation due to corrosion. Finally, electrically conductive, diamond-like carbon might also be used. In all cases, the thickness of the layer 20 may be between 0.2 and 1 micron thick. The lower electrode 14 may be formed from the same material as the upper electrode 13. However, as there is no necessity that the lower electrode 14 be flexible, it may be made from thicker or more rigid electrically conductive materials if desired. Lower electrode 14 includes a plurality of conductive panels 22*a–h* electrically connected in parallel to the electrical voltage source 15 via conductive strips 24 which again may be formed via CMOS technology.

The electrical voltage source 15 includes a DC power source 26. One of the poles of the DC power source is connected to the upper electrode 13 via conductor 17*a*, while the other pole of the source 26 is connected to the lower electrode 14 via conductor 17*b* and switching circuit 28. Switching circuit 28 includes a multiplexer 29 capable of serially connecting the conductive panels 22*a–h* of the lower electrode 14 to the DC power source 26 at frequencies up to 12.5 kHz.

Figure 3A:
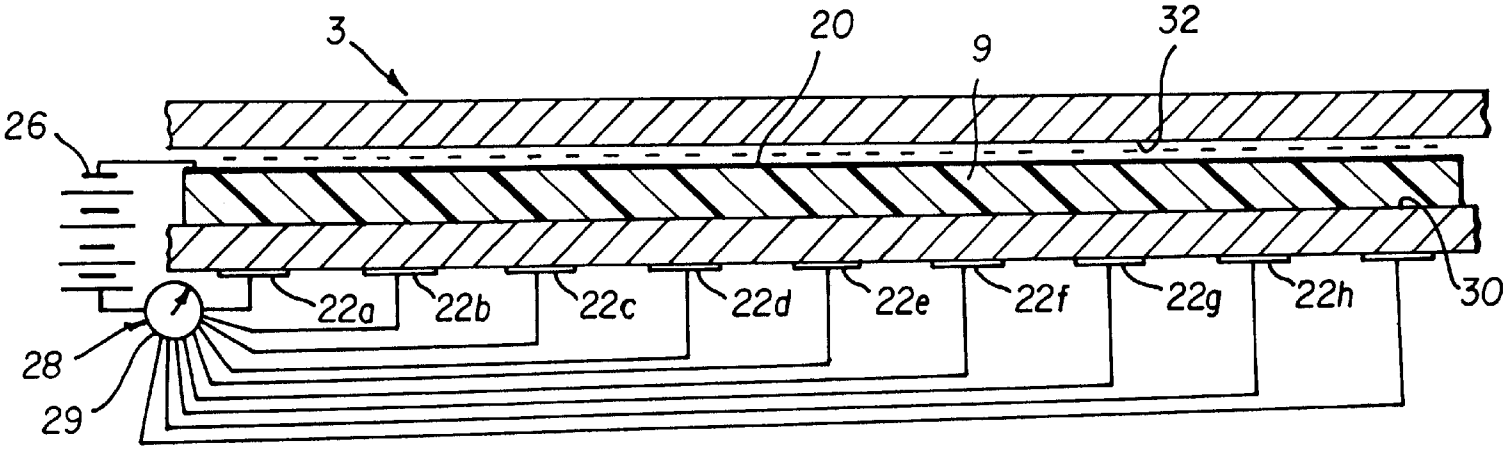
FIG. 3A is an enlarged, cross-sectional side view of the micro-pump illustrated in FIG. 1A with the pump element in a non-pumping, liquid conducting position.
Figure 3B:
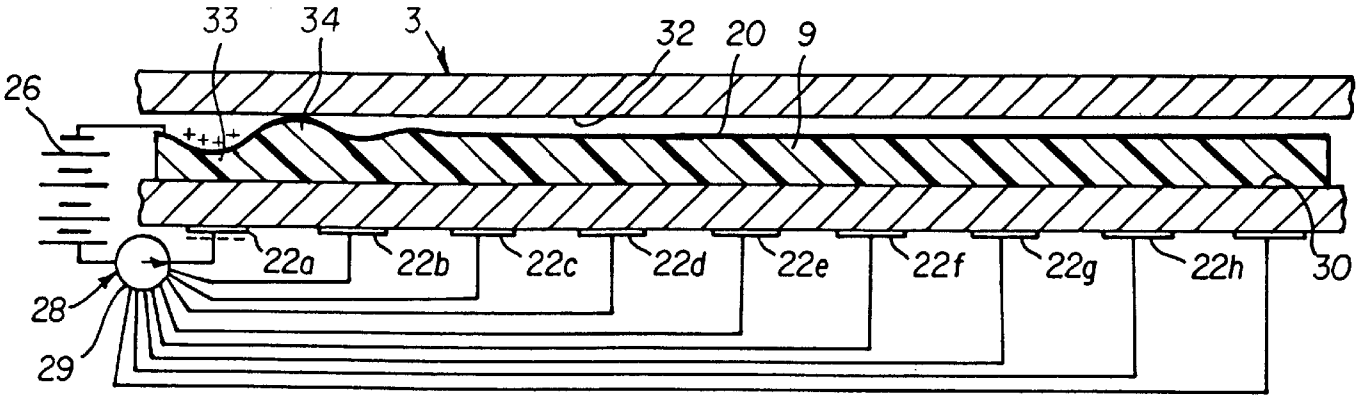
Figure 3C:
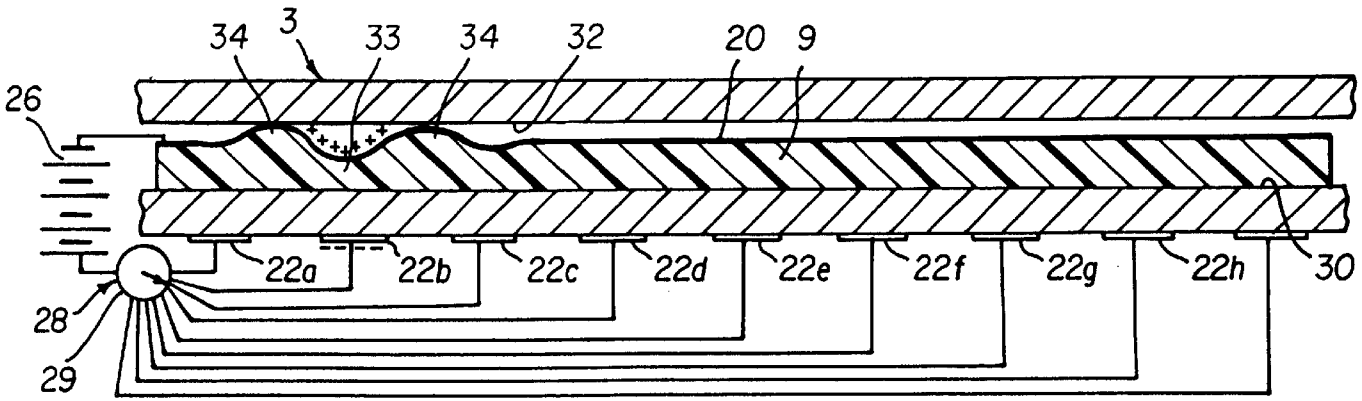
Figure 3D:
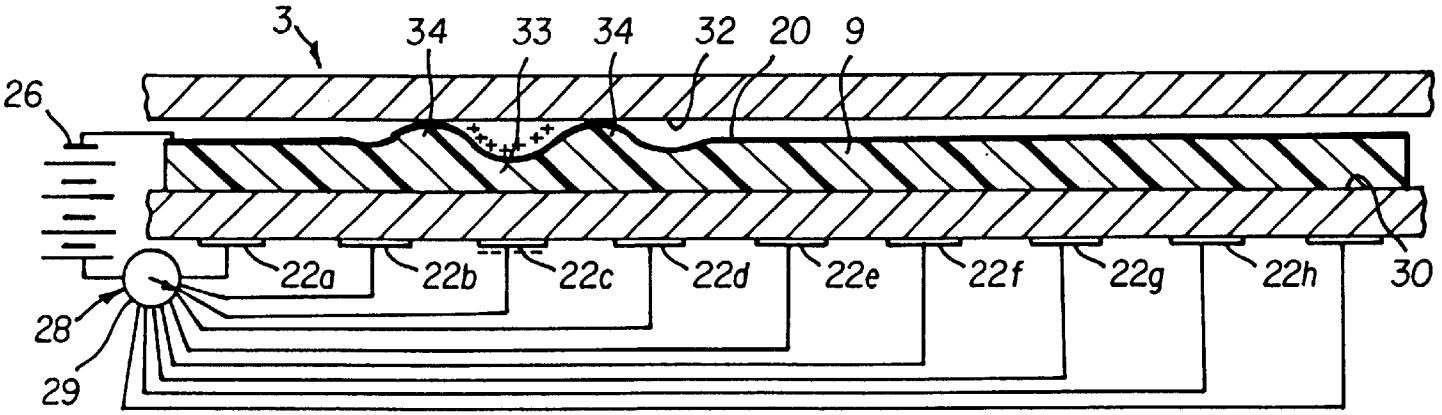
Figure 3E:
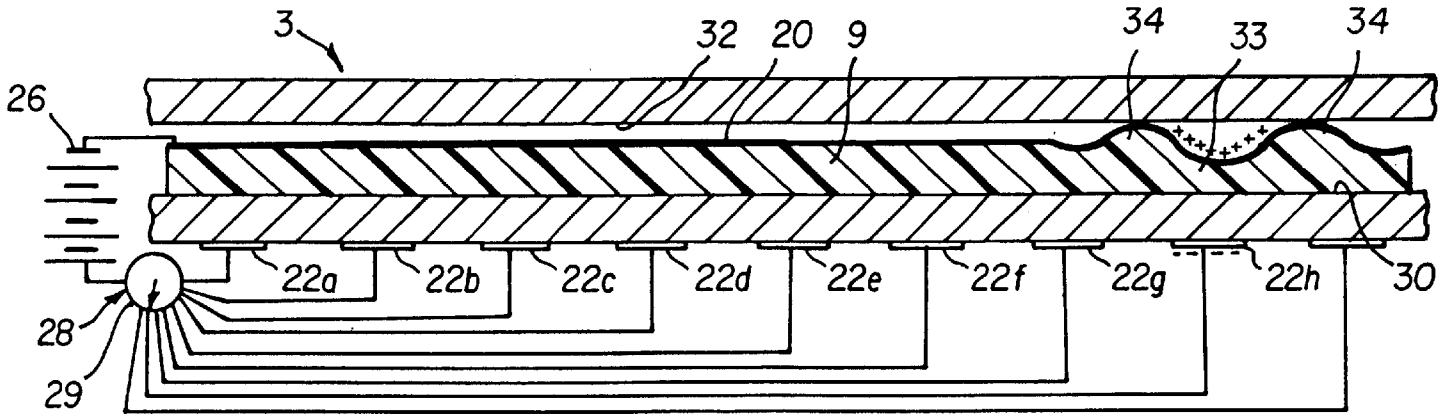

The operation of the electrostrictive micro-pump 1 may best be understood with respect to FIGS. 3A–3E. In FIG. 3A, the multiplexer 29 of the switching circuit 28 applies no electrical potential to any of the conductive panels 22*a–h*. Hence there is no pressure applied to any liquid or other fluid present in the space between upper inner wall 32 of the cannula 4 and the flexible layer of conductive material 20 that forms the upper electrode 13. When the micro-pump 1 is actuated, the multiplexer 29 first connects conductive panel 22*a* to the bottom pole of the DC power source 26. This action generates an electrostatic force between the panel 22*a* and the portion of the flexible, conductive material 20 immediately opposite it. The resulting electrostatic attraction creates a pinched portion 33 in the viscoelastic material forming the pump element 9. As a result of the law of conservation of matter, an enlarged power 34 is created immediately adjacent to the pinched portion 33. As is illustrated in FIG. 3C, the multiplexer 28 proceeds to disconnect the panel 22*a* from the DC power source 26 and to subsequently connect the next adjacent conductive panel 22*b* to the source 26. This action in turn displaces both the pinched portion 33 and enlarged portion 34 of the viscoelastic pump element 9 incrementally to the right. FIGS. 3D and 3E illustrate how the sequential actuation of the remaining conductive panels 22*c–h* effectively propagates the enlarged portion 34 toward the right end of the pump element 9. As the peak of the enlarged portion 34 contacts the upper inner wall 32 throughout its rightward propagation, the pump element 9 peristaltically displaces the small volume of liquid disposed between the layer 20 and the upper wall 32 of the cannula 4, thereby generating a pressure that causes liquid to be expelled out of the outlet 8.

It should be noted that the displacement of the micro-pump 1 may be adjusted by preselecting the volume in the cannula between the upper layer 20 forming the upper electrode 13 and the upper inner wall 32 of the cannula passageway 7. The rate of fluid displacement may be controlled by adjusting the frequency of the multiplexer 29. To compensate for the inherently lower amplitude of the enlarged portion 34 in the pump element 9 at higher frequencies, the voltage generated by the DC power source may be increased so that the peak of the resulting enlarged power 34 engages the upper inner wall 32 during its propagation throughout the length of the pump element 9.

Figure 4:
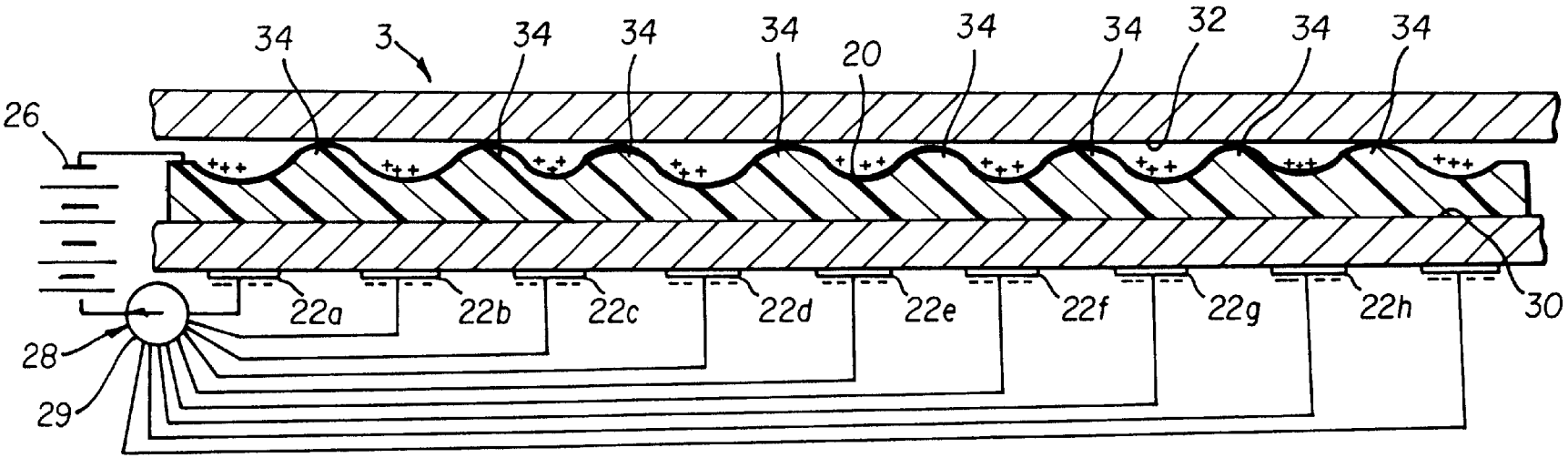
FIG. 4 is a perspective, side view of the micro-pump of the invention illustrating how the voltage source and switching circuit of the control assembly can apply an electrostatic force across all of the conductive panels of the lower electrode in order to deform the pump element into a non-fluid conducting position.

One of the advantages of the micro-pump 1 of the invention is that the pumping action may be positively stopped by applying an electrical potential simultaneously to each of the conductive panels 22*a–h*. This particular operation of the invention is illustrated in FIG. 4. When the multiplexer 29 applies a voltage from the DC power source 26 to all of the panels 22*a–h*, multiple static pinched portions 33 are created which in turn create multiple static enlarged portions 34 which engage the upper wall 32 of the cannula passageway 7. As a result of such operation, the pump element 9 effectively becomes a viscoelastic valve element which positively prevents the flow of further liquid from the vented liquid source 5 through the outlet 8. The capacity of the micro-pump 1 to simultaneously function as a flow restricting valve advantageously obviates the need for the construction and installation of a separate microvalve to control the flow.

While this invention has been described in terms of several preferred embodiments, various modifications, additions, and other changes will become evident to persons of ordinary skill in the art. For example, the micro-pump 1 could also be constructed by mounting two pump elements 9 in opposition on the upper and lower walls 30, 32 of the cannula passageway 7. Each valve element 9 could have its own separate control assembly 11, and the operation of the two control assemblies could be coordinated such that complementary peristaltic waves were generated in the two different pump elements. Such a modification would have the advantage of a greater liquid displacement capacity. All such variations, modifications, and additions are intended to be encompassed within the scope of this patent application, which is limited only by the claims appended hereto and their various equivalents.

PARTS LIST

1. Electrostrictive micro-pump
3. Pump body
4. Cannula
5. Liquid Source
6. Vent hole
7. Passageway
8. Outlet
9. Pump element
11. Control assembly
13. Upper electrode
14. Lower electrode
15. Source of electrical voltage
17. Conductors
19. [Electrodes]
20. Layer of flexible, conductive material
22. Conductive panels a–c
24. Conductive strips
26. DC power source
28, Switching circuit
291 Multiplexer
30. Lower inner wall
32. Upper inner wall
33. Pinched portion
34. Enlarged portion

What is claimed is:

1. An electrostrictive micropump for pumping a flow of fluid, comprising:

a pump body having a passageway for conducting a flow of said fluid;

a pump element formed from a piece of viscoelastic material and having a first side disposed against a wall of said passageway, and a control assembly coupled with said viscoelastic material for inducing an elastic deformation in the shape of a second side of said material while said first side remains undeformed such that a pressure differential is created in fluid disposed in said pump body passageway.

2. The electrostrictive micro-pump defined in claim 1, wherein said control assembly includes first and second electrodes disposed on opposite sides of said viscoelastic material.

3. The electrostrictive micro-pump defined in claim 2, wherein said control assembly includes a source of electrical voltage connected to said first and second electrodes, and a switching means for selectively applying a voltage from said source across said electrodes to generate an electrostatic force therebetween that deforms said viscoelastic material.

4. The electrostrictive micro-pump defined in claim 3, wherein one of said electrode assemblies includes a plurality of conductive panels, and said switching means serially applies a voltage from said voltage source to said conductive panels to induce a peristaltic deformation along said pump body passageway.

5. The electrostrictive micro-pump defined in claim 2, wherein at least one of said electrodes is an electrically conductive coating disposed over one of said sides of said viscoelastic material.

6. The electrostrictive micro-pump defined in claim 5, wherein said coating is a flexible metal coating.

7. The electrostrictive micro-pump defined in claim 5, wherein said coating is an electrically conductive polymer.

8. The electrostrictive micropump defined in claim 1, wherein said pump element is a single piece of viscoelastic material attached to a wall of said passageway.

9. The electrostrictive micro-pump defined in claim 4, wherein said switching means includes a multiplexer.

10. The electrostrictive micro-pump defined in claim 1, wherein said viscoelastic material forming said pump element is a silicon elastomer.

11. An electrostrictive micropump for pumping a flow of fluid, comprising:

a valve body having an elongated passageway for conducting a flow of said fluid;

a pump element formed from a piece of viscoelastic material and having a bottom wall mounted on a wall of said passageway, and a top wall; and a control assembly including first and second electrodes disposed over said top and bottom walls of said viscoelastic material for inducing an elastic deformation in the shape of said top wall of said material while said bottom, mounted wall remains undeformed that creates a pressure differential in fluid disposed in said pump body passageway.

12. The electrostrictive micropump defined in claim 11, wherein one of said electrodes includes a plurality of conductive panels serially disposed along an axis of said passageway, and said control assembly includes a source of electrical voltage, and a switching means for selectively applying voltage from said source across said electrodes that form the shape of said material.

13. The electrostrictive micro-pump defined in claim 12, wherein said switching means serially applies a voltage from said voltage source to said electrically conductive panels of one of said electrodes to induce a peristaltic deformation axially along said passageway.

14. The electrostrictive micropump defined in claim 13, wherein one of said electrodes is an electrically conductive coating disposed over the top wall of said viscoelastic material.

15. The electrostrictive micro-pump defined in claim 14, wherein said coating is a flexible metal coating selected from the group consisting of gold, silver, aluminum, and nickel.

16. The electrostrictive micro-pump defined in claim 14, wherein said coating is diamond-like carbon.

17. The electrostrictive micro-pump defined in claim 14, wherein said coating is a flexible conductive polymer.

18. The electrostrictive micro-pump defined in claim 17, wherein said coating is selected from one of the group consisting of polypyrrole, polyanaline, and polythiophene.

19. The electrostrictive micro-pump defined in claim 11, wherein said viscoelastic material is a silicon elastomer.

20. The electrostrictive micro-pump defined in claim 12, wherein said switching means includes a multiplexer.

21. An electrostrictive micropump for pumping a flow of fluid, comprising:

a pump body having a passageway for conducting a flow of said a pump element formed from a piece of viscoelastic material and disposed in said passageway; and a control assembly coupled with said viscoelastic material for inducing an elastic deformation in the shape of said material that creates a pressure differential in fluid disposed in said pump body passageway, wherein said pump element is a single piece of viscoelastic material attached to a wall of said passageway.

22. An electrostrictive micropump for pumping a flow of fluid, comprising:

a pump body having a passageway for conducting a flow of said fluid;

a pump element formed from a piece of viscoelastic material and disposed in said passageway; and a control assembly coupled with said viscoelastic material for inducing an elastic deformation in the shape of said material that creates a pressure differential in fluid disposed in said pump body passageway, wherein said viscoelastic material forming said pump element is a silicon elastomer.

23. An electrostrictive micropump for pumping a flow of fluid, comprising:

a valve body having an elongated passageway for conducting a flow of said fluid;

a pump element formed from a piece of viscoelastic material and having a bottom wall mounted on a wall of said passageway, and a top wall; and control assembly including first and second electrodes disposed over said top and bottom walls of said viscoelastic material for inducing an elastic deformation in the shape of said material that creates a pressure differential in fluid disposed in said pump body passageway, wherein one of said electrodes includes a plurality of conductive panels serially disposed along an axis of said passageway, and said control assembly includes a source of electrical voltage, and a multiplexer for selectively applying voltage from said source across said electrodes that form the shape of said material.

* * * * *